United States Patent [19]

Woolley

[11] Patent Number: 5,037,669

[45] Date of Patent: Aug. 6, 1991

[54] METHODS OF MANUFACTURING ELECTROMAGNETIC ARTICLES

[75] Inventor: Robert A. Woolley, Uxbridge, England

[73] Assignee: THORN EMI plc, London, England

[21] Appl. No.: 597,704

[22] Filed: Oct. 12, 1990

[30] Foreign Application Priority Data

Oct. 13, 1989 [GB] United Kingdom ..... 8923156

[51] Int. Cl.[5] ..... B05D 3/14

[52] U.S. Cl. ..... 427/47; 204/30; 427/171; 427/128; 427/129; 427/130; 427/131; 427/132

[58] Field of Search ..... 427/47, 171, 128–132; 204/30

*Primary Examiner*—Bernard Pianalto

*Attorney, Agent, or Firm*—Fleit, Jacobson, Cohn, Price, Holman & Stern

[57] ABSTRACT

An electromagnetic article, such as a responder tag for detection by an electronic article surveillance (EAS) system, is fabricated by forming a deposit of a relatively low coercivity high permeability magnetic material on a substrate 22 under the influence of an applied magnetic field so as to provide the deposit with easy and hard axes of magnetization. During deposition the substrate is subjected to a mechanical tension 32 so as to provide the deposit with an inherent benign strain substantially aligned with one of the axes of magnetization. The inherent benign strain is arranged to dominate any detrimental strain to which the responder tag may be subjected during use, enabling detection by the EAS system to be maintained.

20 Claims, 5 Drawing Sheets

DIRECTION OF BENDING

EASY AXIS TENSION (BENIGN)

EASY AXIS COMPRESSION (DETRIMENTAL)

HARD AXIS TENSION (DETRIMENTAL)

HARD AXIS COMPRESSION (BENIGN)

DIRECTION OF BENDING STRAIN

METHODS OF MANUFACTURING ELECTROMAGNETIC ARTICLES

The present invention relates to methods of manufacturing electromagnetic articles and in particular, electromagnetic articles for use as responder tags in Electronic Article Surveillance (EAS) systems.

Usually, EAS Systems utilise responder tags attached to protected goods to inhibit the unauthorised removal of the goods from a surveilled area, such as retail premises. A common form of responder tag for use with such systems comprises a high permeability low coercivity magnetic element in ribbon form. This element, when interrogated by an alternating magnetic field of the EAS system, produces a characteristic signal which can be detected by suitable circuitry. Hence, the characteristic signal enables the tag to be distinguished from other metallic and/or magnetic materials within the interrogating field, enabling monitoring of goods passing through the area whilst minimising the false alarm rate.

The high permeability tagging elements may be made in thin film form usually of rectangular shape, and generally comprise a layer of NiFe (75/25) of approximately 1 micron thickness supported on a significantly thicker substrate with a well defined 'in-plane' axis of magnetisation determined during manufacture. In practice it is often desirable for the tag to be flexible so that it can be attached to goods possessing a curved surface. In this regard, a flexible substrate such as polyester (PET) film may be used to support the NiFe film. However, bending of the tag around a curved surface produces a mechanical strain in the high permeability NiFe film. If the soft magnetic layer exhibits positive magnetostriction, such as NiFe alloys having a 30% to 80% Nickel content, then its permeability may be significantly reduced when so strained, modifying the characteristic signal produced for detection in the EAS monitoring equipment. Such signal modification is undesirable as the EAS system may then not be able to distinguish the tag from other magnetic materials, possibly enabling the undetected removal of the tagged goods from the surveilled area.

It has previously been proposed to overcome this problem by using a non-magnetostrictive and therefore strain insensitive alloy composition to fabricate the responder tag, such as an 80% Ni, 20% Fe alloy composition. In practice, however, it is very difficult to achieve sufficient uniformity and consistency of composition in manufacture to produce an adequately non-magnetostrictive film. Therefore, tags with such alloy compositions have still proved unsatisfactory in practical applications.

The present invention seeks to alleviate these problems by the provision of a tag, and methods of manufacture, in which the sensitivity to bending, within practical limits, is substantially reduced and for which precise control of alloy composition is not required.

Accordingly, there is provided a method of manufacturing an electromagnetic article, the method comprising subjecting a substrate to a mechanical strain and forming a deposit of a relatively low coercivity high permeability magnetic material on the substrate under the influence of an applied magnetic field thereby to provide the deposit with an easy and a hard axis of magnetisation and an inherent benign strain substantially aligned with one of the axes of magnetisation.

The benign strain may comprise a tensile strain substantially aligned with the easy axis of magnetisation or a compressive strain substantially aligned with the hard axis of magnetisation.

The magnetic material may be deposited by electrolytic deposition.

The substrate may be subjected to the mechanical strain by bending the substrate about a curved surface curved about an axis substantially aligned with one of the axes of magnetisation. Alternatively the substrate may be subjected to the mechanical strain by tensioning the substrate in a direction substantially aligned with one of the axes of magnetisation.

The magnetic material may also be deposited as a plurality of layers.

Preferably, the substrate comprises polyester and the magnetic material comprises NiFe alloy having a nickel content between 30% and 80%. The electromagnetic article may also comprise a further layer of relatively high coercivity low permeability magnetic material for controlling the response of the layer of relatively low coercivity high permeability magnetic material to an electromagnetic surveillance system.

BRIEF DESCRIPTION OF THE DRAWINGS

The present invention will now be described, by way of example, with reference to the accompanying drawings in which.

DETAILED DESCRIPTION OF THE DRAWINGS

Figure 1:
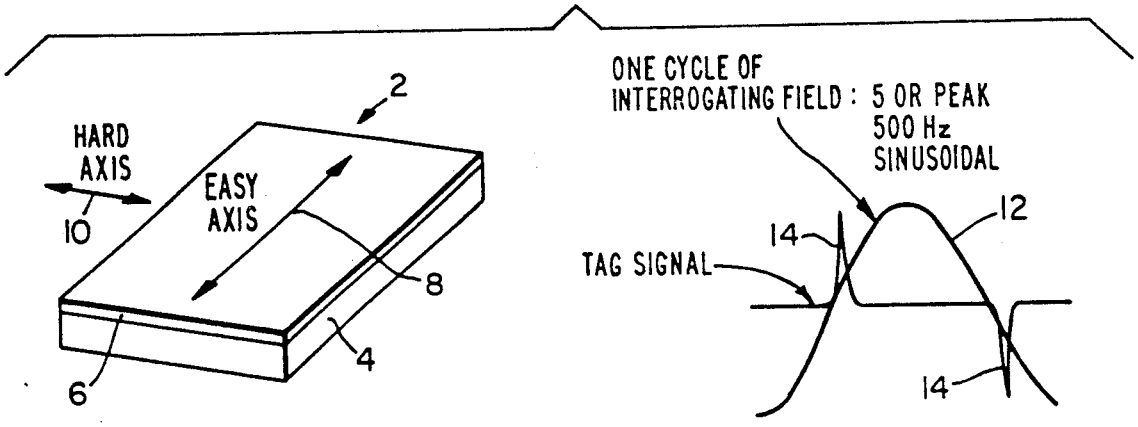
FIG. 1 illustrates a responder tag for use with an electronic article surveillance system and shows also the characteristic signal generated when such a tag is interrogated by an alternating magnetic field.

Referring to FIG. 1, a responder tag 2 comprises a substrate 4, such as 75 micron thickness polyester (PET) carrying a layer 6 of relatively soft, i.e. high permeability low coercivity, magnetic material. The layer 6 may be formed by electroplating onto a conductive layer such as copper (not shown) formed on the substrate and may comprise, typically, a 1 micron thick film of NiFe alloy having a content of 75% Nickel and 25% Iron. As can be seen from FIG. 1, the tag 2 is provided with easy and hard axes of magnetisation 8, 10. These well defined axes of magnetisation may be determined during manufacture, such as by applying the layer 6 under the influence of a direct current magnetic field. Such axes, and their definition during manufacture, will be assumed to be readily understood by those skilled in this art and will not, therefore, be described in more detail in the present application.

The tag 2, when interrogated by an interrogating magnetic field of an EAS system, such as a typical 400 amperes/metre (5 oersted) peak amplitude 500 Hz sinusoidal magnetic field 12 as shown in FIG. 1, produces a characteristic pulse response 14 which is interpreted by the EAS system to identify a tag passing through the surveilled area.

The tag 2 shown in FIG. 1 has, typically, a length of about 35 mm and a width in the region of 25 mm and the polyester substrate thickness provides flexibility which enables the tag 2 to be readily attached or bonded to goods, including those possessing a curved surface. However, as previously stated, the NiFe alloy exhibits positive magnetostriction and, bending the tag around a curved surface produces a strain in the NiFe layer 6 which can reduce significantly the permeability of the layer 6 and, consequently, a modification in the characteristic signal 14 produced by the tag when interrogated by the field 12. With such NiFe alloys tensile strain in the easy axis direction or compressive strain in the hard axis direction has little effect on permeability, such strains being referred to as 'benign strains' in the context of the present invention. Compressive strain in the easy axis direction or tensile strain in the hard axis direction causes a reduction in the permeability of the layer 6 and may be termed 'detrimental strains'. These categories of strain may be produced by appropriate bending of the tag 2 as shown in FIGS. *2a*, *2b*, *2c* and *2d*. It can be seen from FIGS. *2a* and *2d* that when the tag is bent so as to be subject to a benign strain, the characteristic sharp pulses 14 continue to be produced when the tag is interrogated by the field 12. However, when the tag 2 is subject to a detrimental strain, such as by bending as shown in FIGS. *2b* and *2c*, the characteristic sharp pulses are no longer produced upon interrogation by the field 12.

Figure 4:
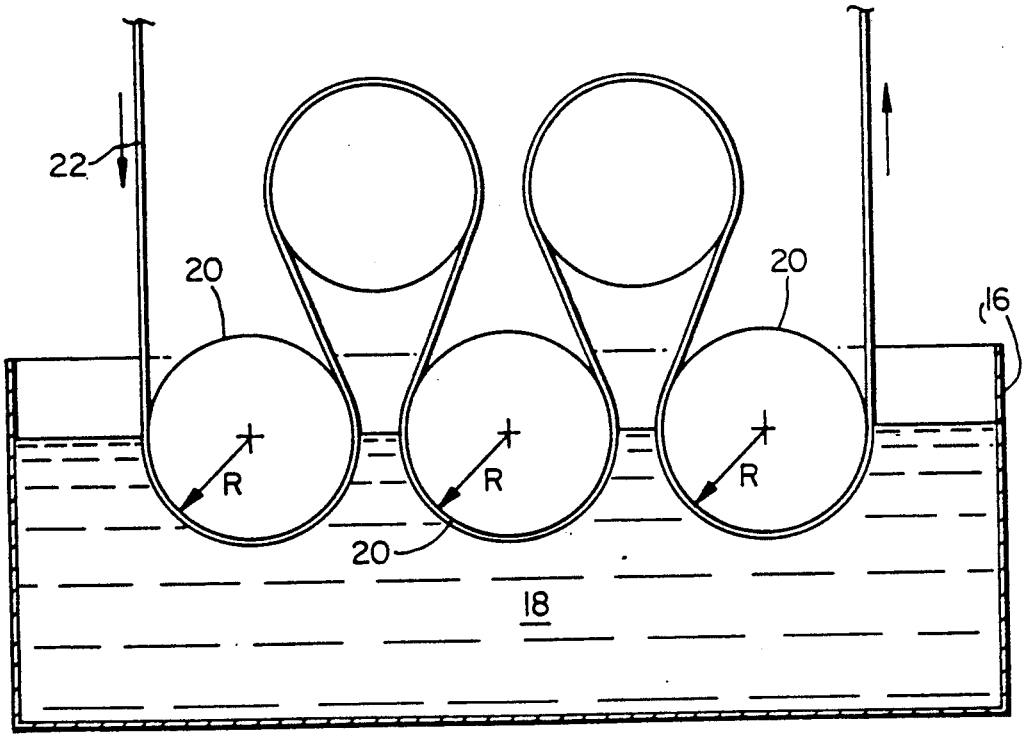
FIG. 4 illustrates an alternative method of manufacturing a responder tag in accordance with the present invention.
Figure 2A:
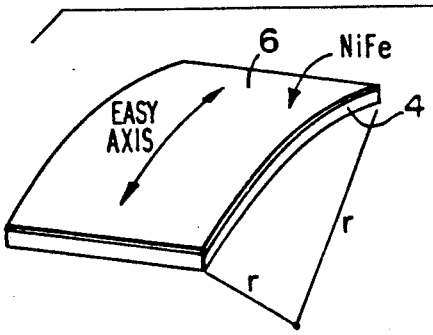
FIGS. 2*a* to 2*d* illustrate the effect of tensile strain on the permeability of a responder tag.
Figure 2A:
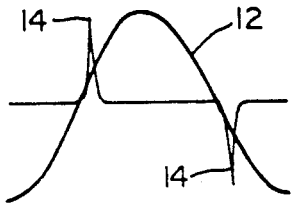
Figure 2B:
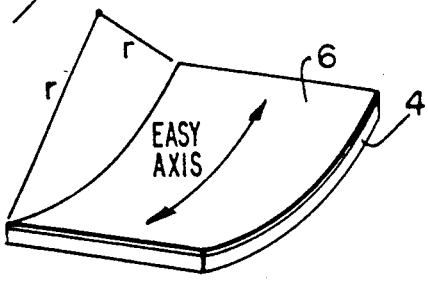
Figure 2B:
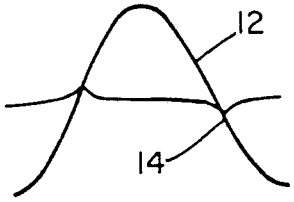
Figure 2C:
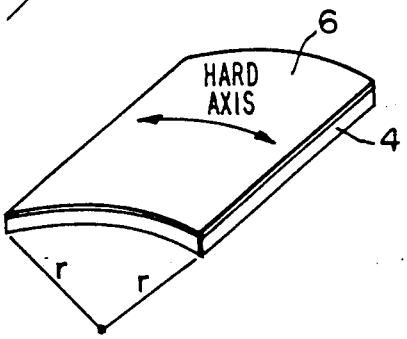
Figure 2C:
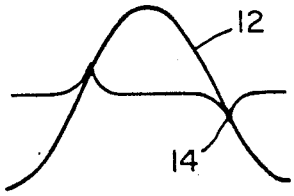
Figure 2D:
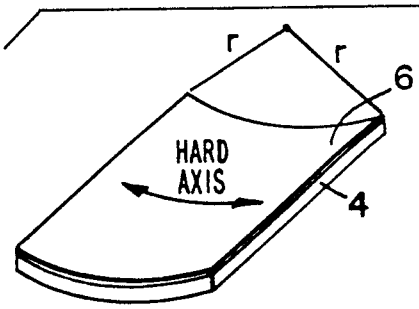
Figure 2D:
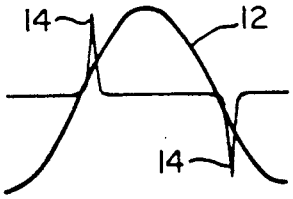

In the present invention, the tag 2 is provided during manufacture with an inherent benign strain which is larger than any detrimental strain which the tag is expected to experience in use. This inherent benign strain may be produced by manufacturing the tag 2 by the apparatus shown in FIG. 3. A plating bath 16 holds an electrolytic solution 18 containing nickel sulphate and iron sulphate for the deposition of the NiFe alloy, the deposited NiFe alloy having a nickel content of between 30% and 80% so as to exhibit positive magnetostriction. The bath 16 houses a drum 20 of radius R having at least a portion of its surface extending into the solution 18. A roll of PET substrate 22 carrying a conductive layer of copper (not shown) is passed around the drum 20 through the solution 18 to provide a metallised film 24 of NiFe on the substrate 22. The responder tags 2 are subsequently cut from the resulting metallised substrate. The NiFe film 24 is described above as being deposited by electroplating but it is to be understood that other methods of deposition may also be employed. The easy axis of magnetisation of the film 24 is made to lie transversely of the substrate 22 by the application of a DC magnetic field 25, substantially aligned with the axis of the drum 20, in the region of deposition from a magnetic source 26 such as a bar magnet or an electromagnet. To improve deposition efficiency the substrate 22 may be wound past a number of drums 20, as shown in FIG. 4.

Figure 3:
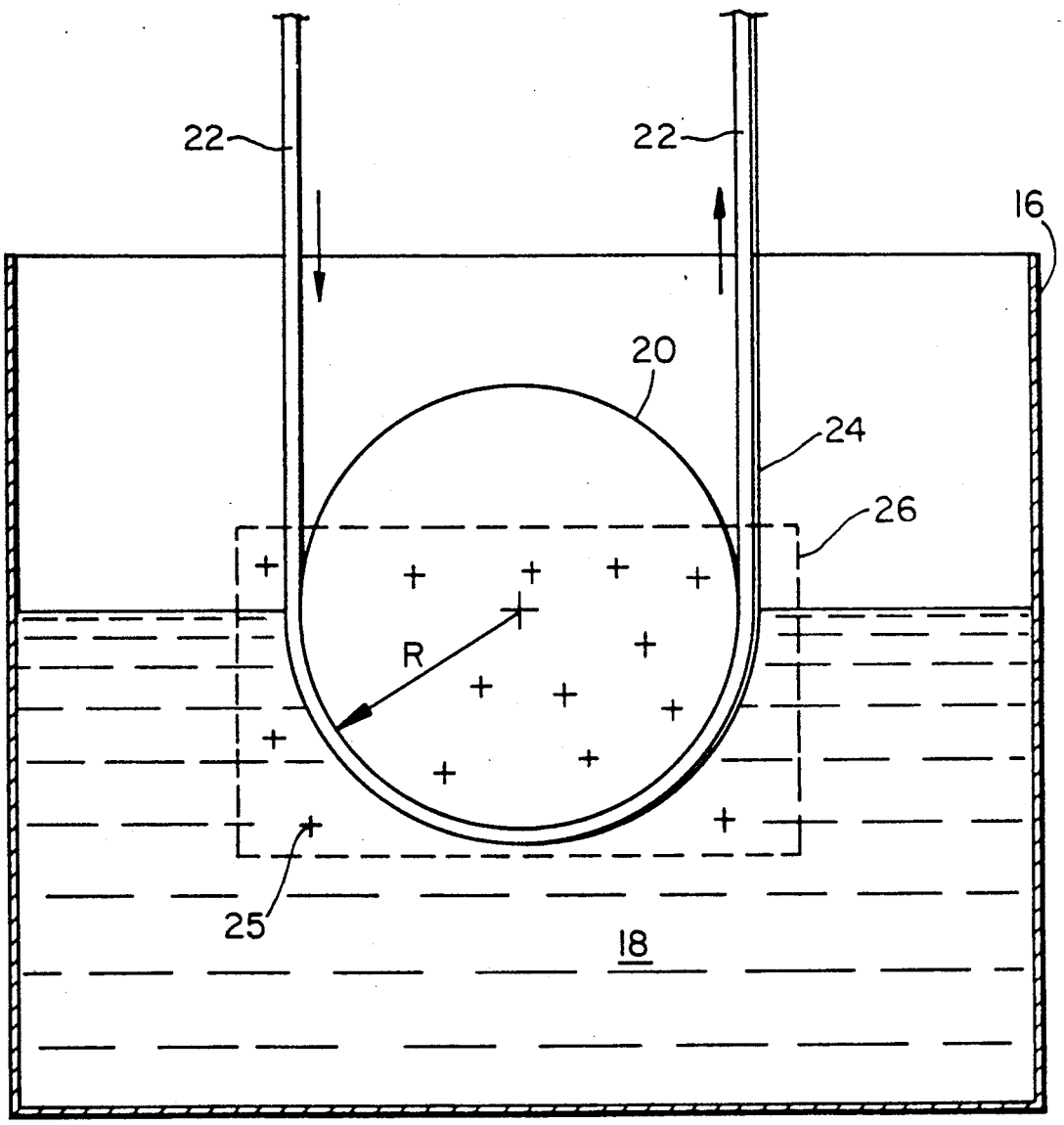
FIG. 3 illustrates one method of manufacturing a responder tag in accordance with the present invention.
Figure 5A:
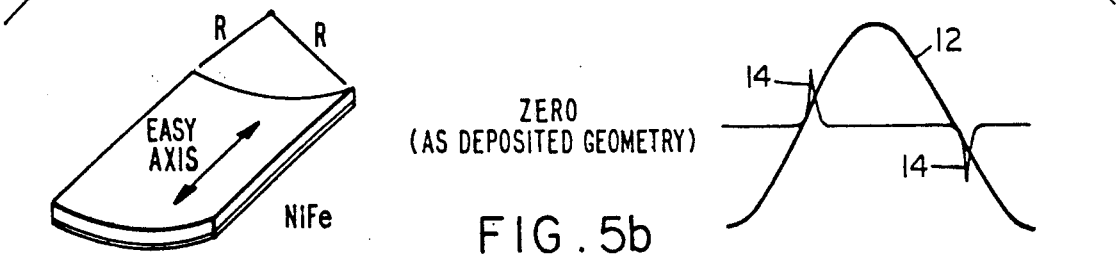
FIGS. 5*a* to 5*e* illustrate a responder tag in accordance with the present invention and showing the effect of tensile strain on the permeability of the tag.
Figure 5B:
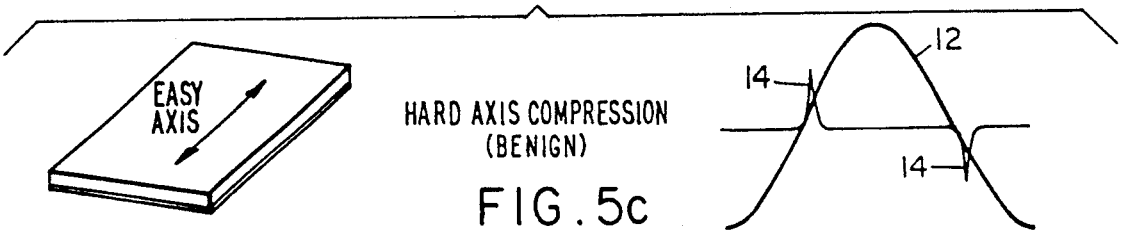
Figure 5C:
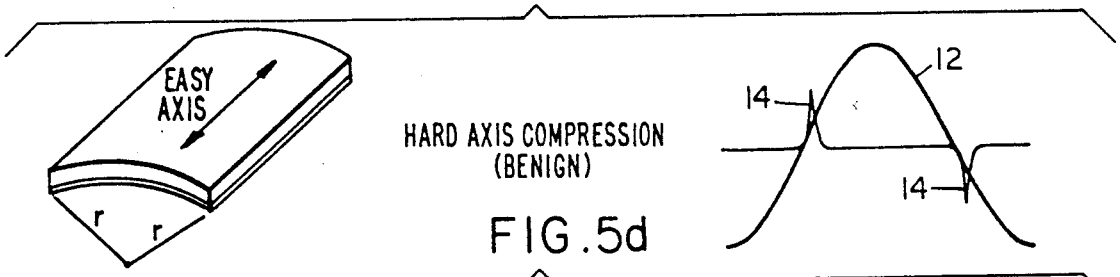
Figure 5D:
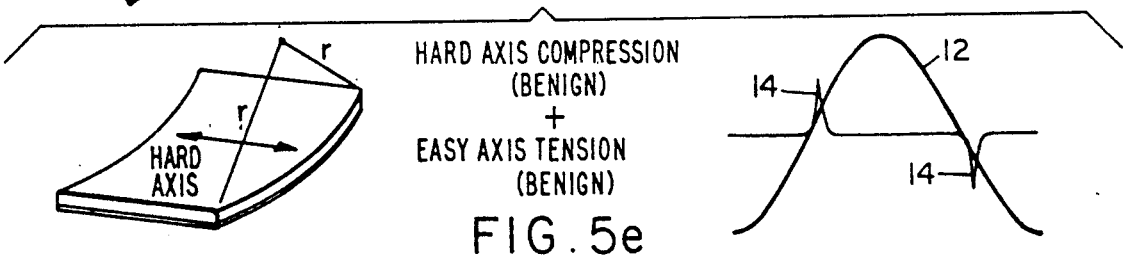
Figure 5E:
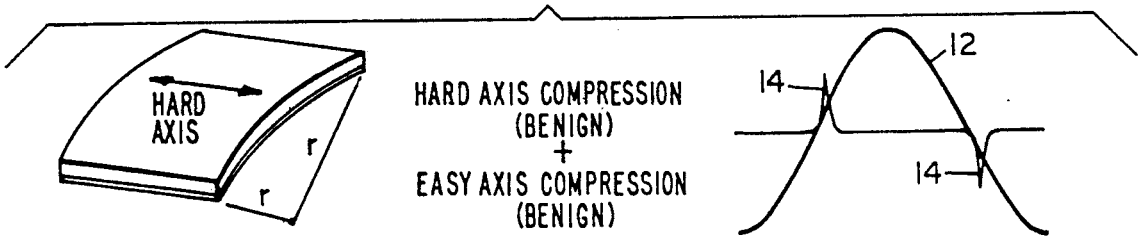

A tag 28, manufactured by the method described with reference to FIG. 3, is shown in its unstrained state in FIG. *5a* i.e. with a radius of curvature R corresponding to the radius of the drum 20. It can be seen from FIG. *5a* that the tag 28, with the 'as deposited' geometry, produces the desired characteristic sharp pulses 14 when interrogated by the field 12. If the tag 28 is flattened, as shown in FIG. *5b*, or bent further about the easy axis of magnetisation, as shown in FIG. *5c*, then the NiFe film experiences only a hard axis compressive strain which is benign. The characteristic sharp pulses 14 are, therefore, maintained when the tag 28 is interrogated by the field 12.

If the tag 28 is flattened and then bent so as to have a curvature about an axis parallel to the hard axis of magnetisation, then the NiFe film experiences simultaneously a hard axis compressive strain (benign) and also an easy axis strain; either a tensile strain (benign—as shown in FIG. *5d*) or a compression strain (detrimental as shown in FIG. *5e*), depending upon the direction in which the tag 28 is bent. In all cases, provided that the radius of curvature r to which the tag 28 is bent is greater than the manufacturing radius R, the benign hard axis compressive strain dominates and the characteristic high permeability sharp pulses 14 are maintained when the tag 28 is interrogated by the field 12. The tag 28 with inherent benign strain may also be fabricated using other deposition methods, magnetic materials and substrates, such as the deposition of a NiFe alloy onto a copper foil of 60 microns thickness.

Figure 6:
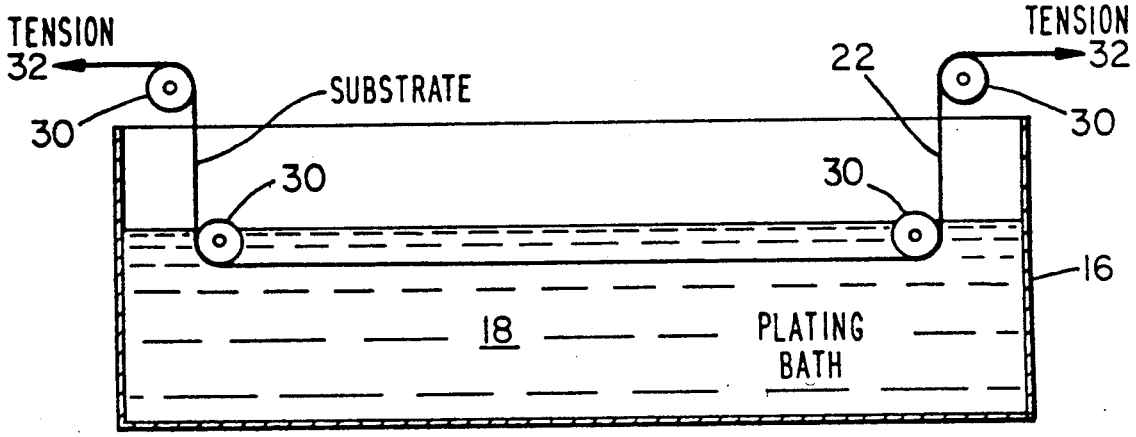
FIG. 6 illustrates a further method of manufacturing a responder tag in accordance with the present invention.

The NiFe film may also be provided with an inherent benign strain by depositing the soft magnetic material onto a tensioned substrate, as shown in FIG. 6. In the apparatus shown in FIG. 6 the plating bath 16, as in FIG. 3, holds the electrolytic solution 18 for the deposition of the NiFe alloy. The substrate 22 is guided through the bath 16 by a set of rollers 30 and a tensile strain 32 is applied longitudinally within the substrate 22. The tensile strain 32 causes an extension of the substrate 22 in the longitudinal direction and a contraction in the transverse direction. As in the method described with reference to FIG. 3, the NiFe film is deposited under the influence of an applied DC magnetic field so as to provide an easy axis of magnetisation within the deposited film lying transversely of the substrate 22.

Figure 7:
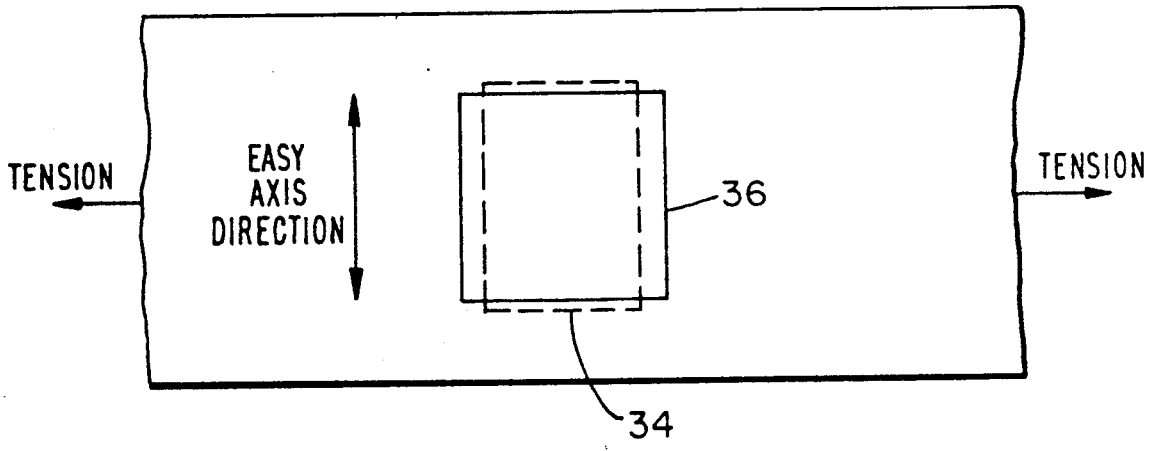
FIG. 7 illustrates a schematic plan view of a section of substrate showing the effect of applying tensile strain longitudinally of the substrate.

The effect of the tensile strain on the substrate 22 can be seen from FIG. 7, in which, for explanatory purposes, a rectangular region of the unstrained substrate is shown as a dotted outline 34 which can be seen to take up a more elongate shape in the longitudinal direction of the substrate 22 under the effect of the tensile strain, as shown by the solid rectangle 36.

Following the deposition of the NiFe film with a transversely oriented easy axis of magnetisation, the tension is removed, thus enabling the substrate to return to its original shape, i.e. the shape of the solid rectangle region 36 reverts to the shape of the dotted region 34. This yields an easy axis tensile strain and a hard axis compressive strain in the NiFe film, both of which are benign. In practical experiments, using 75 micron thickness PET substrate and a longitudinal tension of 500N/linear meter (providing about 0.2% longitudinal extension of the substrate), NiFe alloy tags with 75% nickel and 25% iron content have been produced with a similar bending response to those produced using the apparatus shown in FIG. 3. Thinner or lower modulus substrates could also be used in the apparatus shown in FIG. 6, with proportionately lower tensions being required to achieve the desired benign strain.

Figure 8:
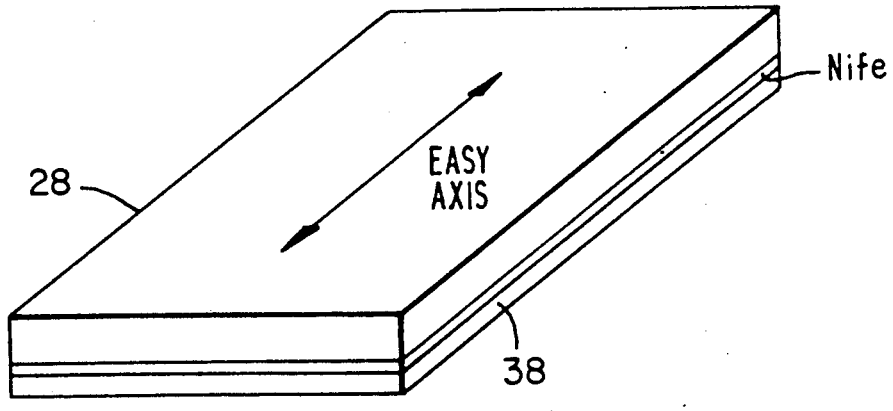
FIG. 8 illustrates a responder tag including a further layer of relatively hard magnetic material.

Although the present invention has been described with respect to specific embodiments, it is to be understood that modifications may be effected whilst remaining within the scope of the invention. For example, the tag 28 with inherent benign strain may also be provided with an additional layer or layers 38 of a relatively high coercivity magnetic material or materials, as shown in FIG. 8, for controlling the response of the high permeability NiFe film to the EAS equipment.

Additionally, the above preferred methods of NiFe deposition may be combined in that a substrate tension may be applied, as in the apparatus shown in FIG. 6, whilst the substrate 22 is passed around the drum 20, as in the apparatus of FIGS. 3 and 4.

Furthermore, the tags may be fabricated using a magnetic material which exhibits negative magnetostriction, for example Nickel, with an inherent easy axis compressive strain or a hard axis tensile strain, both of which are benign for such materials, to maintain the characteristic high permeability signal when interrogated by EAS equipment.

I claim:

1. A method of manufacturing an electromagnetic article, the method comprising subjecting a substrate to a mechanical strain and forming a deposit of a relatively low coercivity high permeability magnetic material on the substrate under the influence of an applied magnetic field thereby to provide the deposit with an easy and a hard axis of magnetisation and an inherent benign strain substantially aligned with one of the axes of magnetisation.

2. A method according to claim 1 wherein the benign strain comprises a tensile strain substantially aligned with the easy axis of magnetisation.

3. A method according to claim 1 wherein the benign strain comprises a compressive strain substantially aligned with the hard axis of magnetisation.

4. A method according to claim 1 wherein the deposit is formed by electrolytic deposition.

5. A method according to claim 1 wherein the substrate is subjected to the mechanical strain by bending the substrate about a curved surface curved about an axis substantially aligned with one of the axes of magnetisation.

6. A method according to claim 2 wherein the substrate is subjected to the mechanical strain by bending the substrate about a curved surface curved about an axis substantially aligned with one of the axes of magnetisation.

7. A method according to claim 3 wherein the substrate is subjected to the mechanical strain by bending the substrate about a curved surface curved about an axis substantially aligned with one of the axes of magnetisation.

8. A method according to claim 4 wherein the substrate is subjected to the mechanical strain by bending the substrate about a curved surface curved about an axis substantially aligned with one of the axes of magnetisation.

9. A method according to claim 1 wherein the substrate is subjected to the mechanical strain by tensioning the substrate in a direction substantially aligned with one of the axes of magnetisation.

10. A method according to claim 2 wherein the substrate is subjected to the mechanical strain by tensioning the substrate in a direction substantially aligned with one of the axes of magnetisation.

11. A method according to claim 3 wherein the substrate is subjected to the mechanical strain by tensioning the substrate in a direction substantially aligned with one of the axes of magnetisation.

12. A method according to claim 4 wherein the substrate is subjected to the mechanical strain by tensioning the substrate in a direction substantially aligned with one of the axes of magnetisation.

13. A method according to claim 1 wherein the deposit of magnetic material comprises a plurality of layers of magnetic material.

14. A method according to claim 1 wherein the substrate comprises polyester material.

15. A method according to claim 5 wherein the substrate comprises polyester material.

16. A method according to claim 9 wherein the substrate comprises polyester material.

17. A method according to claim 1 wherein the magnetic material comprises an NiFe alloy having a mickel content between 30% and 80%.

18. A method according to claim 2 wherein the magnetic material comprises an NiFe alloy having a nickel content between 30% and 80%.

19. A method according to claim 3 wherein the magnetic material comprisea an NiFe alloy having a nickel content between 30% and 80%.

20. A method according to claim 1 further comprising forming a layer of relatively high coercivity low permeability magnetic material.

* * * * *